United States Patent [19]

Shibata et al.

[11] Patent Number: 4,861,013

[45] Date of Patent: Aug. 29, 1989

[54] MECHANISM FOR PREVENTING THE FEEDING OF MORE THAN ONE SHEET OF PAPER AT ONE TIME

[75] Inventors: Kiyotaka Shibata, Takatsuki; Kiyoshi Morimoto, Osaka, both of Japan

[73] Assignee: Mita Industrial Co., Ltd., Osaka, Japan

[21] Appl. No.: 301,296

[22] Filed: Jan. 25, 1989

Related U.S. Application Data

[62] Division of Ser. No. 850,789, Apr. 11, 1986, abandoned.

[30] Foreign Application Priority Data

Apr. 15, 1985 [JP] Japan ..... 60-80638
Apr. 15, 1985 [JP] Japan ..... 60-56766

[51] Int. Cl.[4] ..... B65H 3/06

[52] U.S. Cl. ..... 271/119; 271/121; 271/122; 271/125

[58] Field of Search ..... 271/119, 121, 122, 124, 271/125, 137; 29/121.5, 121.6, 121.7, 121.1

[56] References Cited

U.S. PATENT DOCUMENTS 3,888,479 6/1975 Eder et al. ..... 271/119 X
4,030,413 6/1977 Young ..... 271/119 X
4,443,006 4/1984 Hasegawa ..... 271/10
4,560,154 12/1985 Nogi et al. ..... 271/10
4,589,650 5/1986 Miyoshi ..... 271/242
4,728,095 3/1988 Irvine et al. ..... 271/124

*Primary Examiner*—Joseph J. Rolla
*Assistant Examiner*—David H. Bollinger
*Attorney, Agent, or Firm*—Armstrong, Nikaido Marmelstein Kubovcik & Murray

[57] ABSTRACT

A mechanism for preventing the feeding of more than one sheet of paper at one time comprising a document feeder having a pair of parallel shafts, one of which is a paper-supply roller shaft supporting a plurality of paper-supply rollers, and the other of which is a separation roller shaft supporting a plurality of separation rollers, wherein the distance between the shafts is slightly less than the sum of the radii of these paper-supply rollers and separation rollers, and said paper-supply rollers and said separation rollers are arranged in a zigzag manner, the outer surface of each of said paper-supply rollers being composed of a large frictional section producing much friction between the paper-supply roller and the paper and a small frictional section producing little friction between the paper-supply roller and the paper.

2 Claims, 7 Drawing Sheets

MECHANISM FOR PREVENTING THE FEEDING OF MORE THAN ONE SHEET OF PAPER AT ONE TIME

BACKGROUND OF THE INVENTION

1. Field of the invention

This invention relates to a mechanism that prevents feeding of more than one sheet of paper, at one time, in the document feeder of an electrostatic copying machine or an electrostatic printing machine.

2. Description of the prior art

In general, in the document feeder of copying machines, in order to prevent the feeding of more than one sheet of paper at one time, there is a mechanism having paper-supply rollers and separation rollers with different coefficients of friction that are paired (Japanese Laid-Open Utility Model Application 58-69842) or a mechanism having paper-supply rollers with cut portions (Japanese Laid-Open Patent Application 58-181618).

This invention relates to an improved mechanism for preventing the feeding of more than one sheet of paper at one time, which mechanism has paper-supply rollers with cut portions. First, the connection of this invention to the prior art is explained using FIG. 3, which shows the diagram of an electrostatic copying machine.

On the upper surface of housing 1 of the copying machine, there is a place 2 on which the manuscript to be copied is placed, and an automatic document feeder 3 that supplies the documents one by one thereto and discharges them therefrom.

Inside housing 1, there is a movable optical system 4 for exposure and a photoreceptor drum 5. The piled-up manuscripts 16 in the manuscript stocker 301 are sent from the top of the pile by the pushing roller 302 and reach the resist roller 305, while paper-supply roller 303 and the separation roller 304 act in preventing more than one sheet from being fed at one time. At this point there is a temporary pause until the driving belt 306 sends the manuscript forward to a fixed position onto the transparent manuscript placement place 2.

Then, the lamp 401 of the movable optical system for exposure 4, the collimating reflector 402, and the first mirror 403 move at velocity V from the position shown in the figure by solid lines to that on the right of the figure shown by dotted lines The second mirror 404 and the third mirror 405 move at velocity $\frac{1}{2}$V to the position shown by dotted line, in the same manner. Thus, scanning exposure takes place via the optical system 4.

At this time, the reflected light from the manuscript 16 that is illuminated by the manuscript illumination lamp 401 forms an image on photoreceptor drum 5 by means of reflections in the order of the first mirror 403, the second mirror 404, the third mirror 405, and the fourth mirror 407 via the lens 406. Upon completion of the scanning exposure in the above-mentioned way, the movable optical reflection system 4 returns again to its original position, and the manuscript 16 is ejected through the ejection route 14 to the manuscript ejection stand 15.

The photoreceptor drum 5, which rotates in the direction of the arrow, has already been charged uniformly with a certain electric polarity by the corona discharger 501. An electrostatic latent image is formed on the surface of the drum that corresponds to the above-mentioned manuscript by means of this exposure treatment.

The latent image is developed with toner via the well-known magnetic brush developer 9. Copy paper that has come from paper-supply cassette 7 or 8 passes through the space between the drum 5 and the transfer corona discharger 502 and that between the drum 5 and separator corona discharger 503, and this toner image is transferred to the copy paper. The paper with the transferred image is conveyed to the fusing means 11 by the discharge belt 10, where the toner image is fused by means of heat to the copy paper and discharged into discharge tray 13 by the discharge roller 12.

The toner left on photoreceptor drum 5 is cleaned by the cleaning apparatus 16.

If necessary, the paper stocker 6 can supply special papers such as postcards, OHP film, tracing paper, etc. The document feeder 3 for supplying papers in the stocker 301 can be used with the stocker 6. Rollers 601 and 602 are simple conveying rollers, which are used to adjust the timing thereof with the manuscript image via the resist roller 605.

The main parts of the automatic document feeder 3 are shown in FIG. 4. The rotatory power is transmitted to the driving shaft (paper-supply roller shaft) 308 of the paper-supply roller 303 and the driving shaft (separation roller shaft) 309 of the separation roller 304 for preventing the feeding of more than one sheet of paper via the power gear 307 from the power transmission apparatus (not shown). To the driving shaft 308 of the paper-supply roller 303, the power of the driving shaft 310 of the pushing roller 302 is transmitted by belt 311, which goes around these two shafts. There are fan-shaped cams 312 on the rotatory shaft 313, for the purpose of establishing the timing of the pushing roller 302. Gears 314, 315, and 316 are provided between the driving shaft 308 and the rotatory shaft 313.

The driving shaft 308 of the paper-supply rollers 303 and the rotatory shaft 313 of the timing cams 312 rotate at the same gear ratio.

The driving shaft 308 of paper-supply roller 303 passes through the swinging levers 320 These levers 320, which are for pushing roller 302, comprise the driving shaft 310 of pushing roller 302, the roller-supporting arms 318 that support weight 317 for balance, and the engaging arms 319 that engage with timing cams 312.

At the end of the engaging arm 319, there is an engaging step 321 that engages with the timing cam 312.

The paper-supply rollers 303 are made of some substance such as rubber or synthetic resin that has a relatively large coefficient of friction. The separation rollers 304 are made of a material with a relatively smaller coefficient of friction compared to the paper-supply rollers.

The paper-supply rollers 303 and the separation rollers 304 are, as shown in FIG. 6, designed so that the distance between their shafts is slightly smaller than the sum of their radii. Ordinarily, during the supplying of paper, manuscript 16 is supplied bent into a wave fashion.

As shown in FIG. 2, there is an indentation 322 n one part of the outer circumference of the paper-supply roller 303, so that when the manuscript 16 arrives at the resist roller 305 and the manuscript is conveyed in the downstream direction, the pressure of the paper-supply roller 303 against the manuscript 16 can be reduced. At this time, the manuscript 16 is sandwiched between the paper-supply roller 303 and the separation roller 304 so as to be flat (FIG. 7).

Next, the working of the above-mentioned document feeder 3 will be explained with reference to FIG. 5.

Document papers 1 6 are piled on the stocker 301, the working of which is the same as that of the paper stocker 6, on which copying paper is piled; below, both documents and copying paper shall be referred to simply as "paper."

The situation at the beginning of copying is shown in FIG. 5(*a*). The pushing roller 302 is lifted over the top of the paper 16 on top of the stocker 301. This pushing roller 302 is positioned on the top of the swinging level 320 that is connected to the timing cam 312.

Paper supply starts in this situation, with the fan-shaped timing cam 312 first rotating to the right and releasing the swinging lever 320. For that reason, the pushing roller 302 drops onto the top of the paper 16 on the stocker 301 and sends the topmost paper in the direction of the paper-supply roller 303 (FIG. 5(*b*)).

The paper-supply roller 303 works with the separation roller 304 rotating in the opposite direction from the direction in which the paper is being sent, so that the paper will be sent in the direction of the pair of resist rollers 305 while multiple feeding of paper will be prevented (FIG. 5(*c*)). The situation in FIG. 5(*c*) is the same as that in FIG. 6, seen from the end of the paper, wherein the paper-supply roller 303 works to strengthen the friction between this roller 303 and the paper 16.

Then, as the paper-supply roller 303 rotates once, the front edge of the paper 16 reaches the resist roller 305, and is stopped with a slight bent for slope compensation.

At this time, the swinging lever 320 is pushed up again by the timing cam 312, and the pushing roller 302 is pulled up from the top of the papers 16 on the stocker 301 (FIG. 5(*d*)).

When the slope compensation of the paper and the timing adjustment are complete, the resist roller 305 pushes the paper 16 in the downstream direction of paper conveyance. At this time, the indented section 322 of the paper-supply roller 303 in the situation shown in FIG. 5(*d*) faces the separation roller 304, so that the load that weighs upon the paper 16 when sandwiched therebetween will be decreased. This situation corresponds to that in FIG. 7; when seen from the end, the paper is completely flat. Thus, the paper 16 is quickly sent downstream in the direction of paper conveyance by the resist roller 305 without resistance.

When a paper-supply roller 303 with such an indentation in part 322 is used, the paper movement from the resist roller 305 downstream becomes smooth, there being only a light load on the paper. At the same time, since the load on the paper by the separation roller 304 has disappeared, the problem arises that the separation of multiple sheets of paper becomes unreliable.

SUMMARY OF THE INVENTION

The mechanism for preventing the feeding of more than one sheet of paper at one time of this invention, which overcomes the above-discussed and numerous other disadvantages and deficiencies of the prior art, comprises a document feeder having a pair of parallel shafts, one of which is a paper-supply roller shaft supporting a plurality of paper-supply rollers, and the other of which is a separation roller shaft supporting a plurality of separation rollers, wherein the distance between the shafts is slightly less than the sum of the radii of these paper-supply rollers and separation rollers, and said paper-supply rollers and said separation rollers are arranged in a zigzag manner, the outer surface of each of said paper-supply rollers being composed of a large frictional section producing much friction between the paper-supply roller and the paper and a small frictional section producing little friction between the paper-supply roller and the paper.

The small frictional section of said paper-supply roller is, in a preferred embodiment, composed of a roller portion with a narrow width.

Alternatively, the small frictional section of said paper-supply roller is made of an adapter, which has a roller-compensating part including a roller-compensating section functioning as one part of the outside of the paper-supply roller and a supporting section for supporting said roller-compensating part that is to be put on the roller shaft so as to be straddled by the paper-supply roller in the direction of the width of the paper-supply roller. The supporting section is, in a preferred embodiment, made of synthetic resin in one piece with said compensating part.

Thus, the invention described herein makes possible the objects of (1) providing a mechanism for preventing the feeding of more than one sheet of paper at one time, in which the load required for the sending of paper in the downstream direction of paper conveyance by the resist roller, etc., is maintained at a low level, and at the same time because of an appropriate amount of friction created between the paper and the separation roller that is in combination with the paper-supply roller, the separation roller functions, thereby attaining the prevention of the feeding of more than one sheet of paper at one time; (2) providing a mechanism for preventing the feeding of more than one sheet of paper at one time, in which by suitable selection of the width of the rollers that have a smaller frictional power the amount of friction between the separation roller and the paper can be regulated, by which reliable prevention of the feeding of more than one sheet of paper at one time can be achieved; (3) providing an adapter supplied with a mechanism for preventing the feeding of more than one sheet of paper at one time, which, in addition to making possible (1) and (2) mentioned above, also makes it possible to strengthen the separation effect required for the differing materials and/or thicknesses of the paper used in copying machines or the like; (4) providing the adapter supplied with the above-mentioned mechanism, which can be selectively installed on the individual paper-supply roller, so that the fine adjustment of the friction between the separation roller and the paper can be achieved; and (5) providing the adapters of various dimensions for various parts, which make it possible to improve the functions of the document feeder of already manufactured copying machines as desired.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

Example 1

Figure 3:
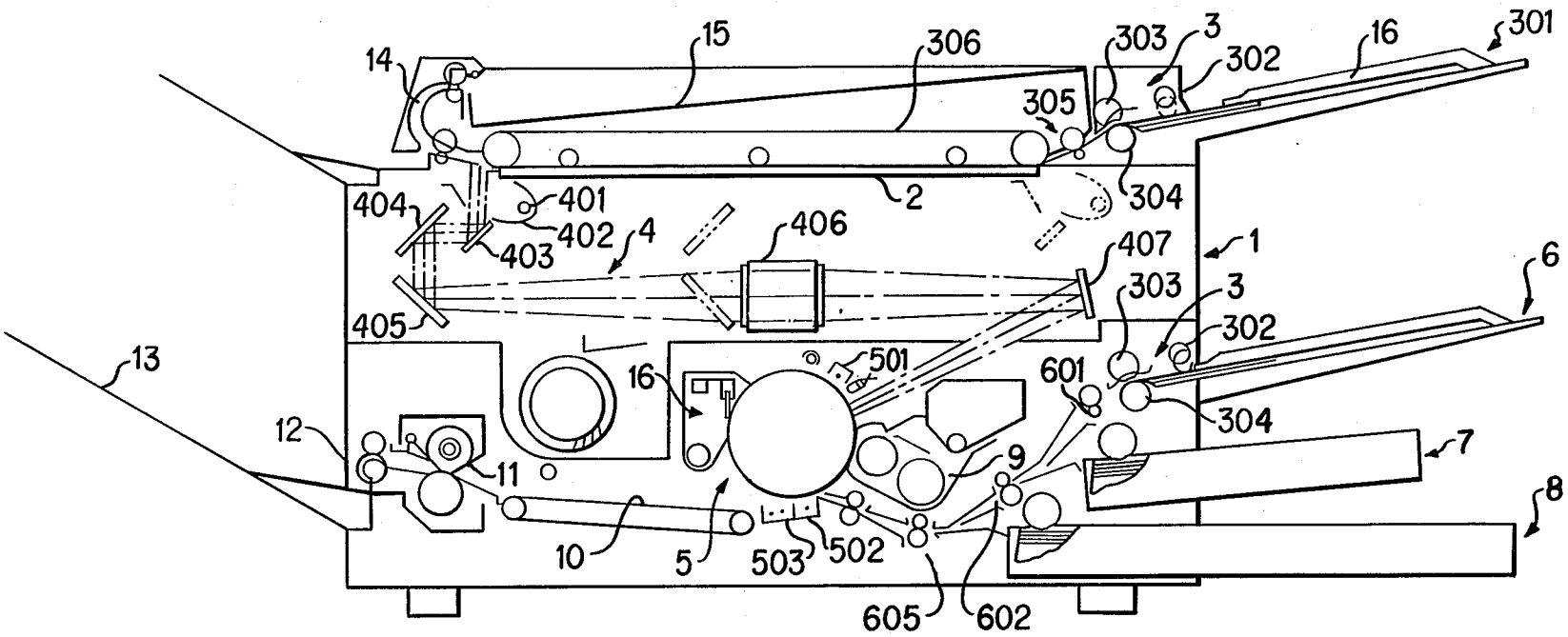
FIG. 3 PRIOR ART
FIG. 3 is a schematic diagram showing an electrostatic copying machine to which this invention is applied.
Figure 4:
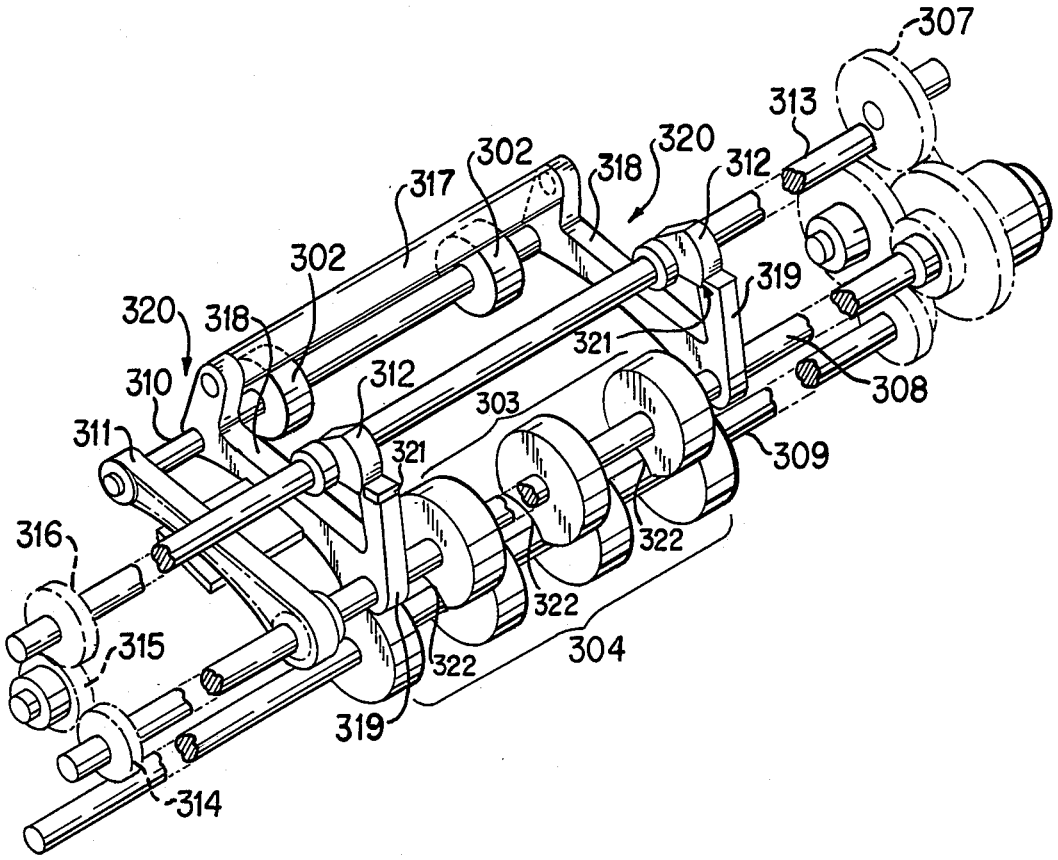
FIG. 4 is a perspective view showing the principal part of the automatic document feeder shown in FIG. 3.
Figure 5C:
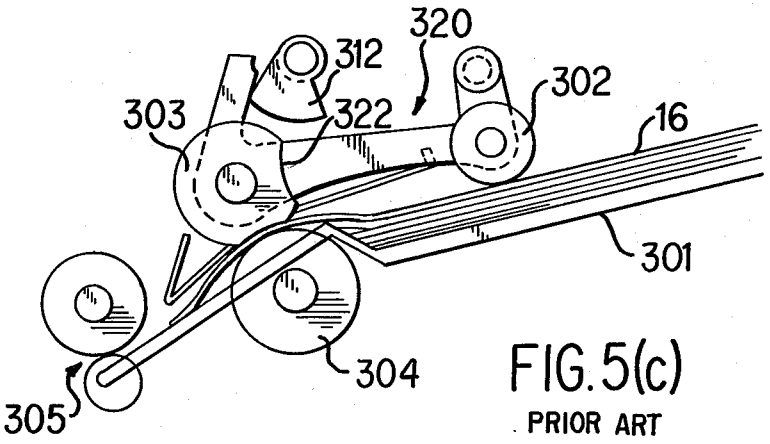
FIG. 5(c) PRIOR ART
FIGS. 5(*a*) to 5(*d*) are schematic diagrams showing operation of the automatic document feeder shown in FIG. 4.
Figure 5D:
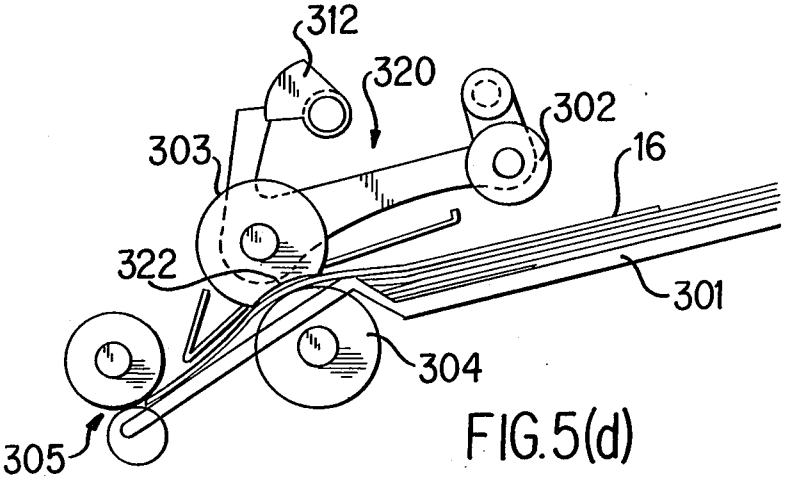
FIG. 5(d) PRIOR ART
Figure 5A:
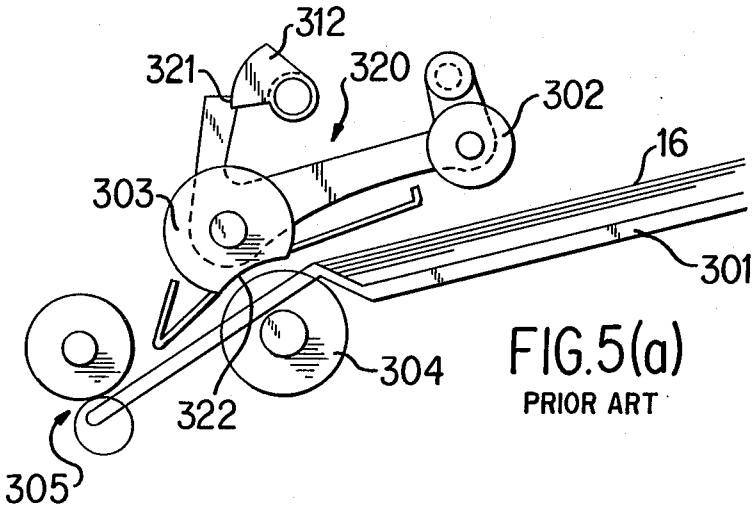
FIG. 5(a) PRIOR ART
Figure 5B:
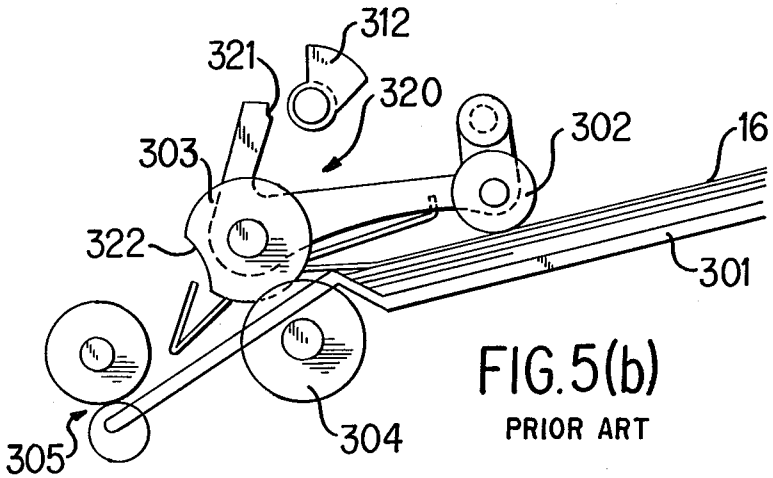
FIG. 5(b) PRIOR ART

The copying machine and document feeder in which the present invention is used are the same as those shown in FIGS. 3 and 4, where they are explained in terms of BACKGROUND OF THE INVENTION. Only the construction of the paper-supply rollers are different. The same numbers for the parts with the same construction are used and the already explained construction is not explained herein.

Figure 1:
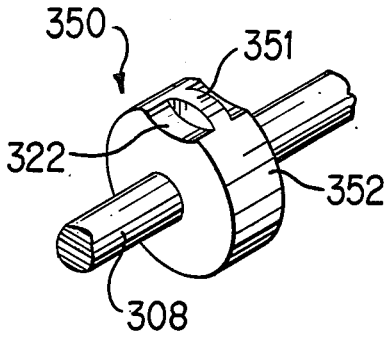
FIG. 1 is a perspective view showing a paper-supply roller of this invention.

FIG. 1 shows a paper-supply roller 350, which is used in the mechanism for preventing the feeding of more than one paper at one time of this invention.

The paper-supply roller 350 (FIG. 1) of this invention is different from the conventional paper-supply roller 303 (FIG. 2) in that it has a small roller part 351 of a narrow width in the indentation 322 in the outer surface of the roller. The conventional roller 303 is not provided with such a narrow part. The paper-supply roller 350 of the present invention is composed of the roller section 352, which has a large area touching the paper resulting in great friction therebetween, and the roller section 351, which has a small area touching the paper resulting in little friction therebetween. This roller section 351 has, as shown in the figure, a small area of contact with the paper, the result of which is to make small the amount of friction therebetween. When the protrusion in this area is of the appropriate size, the pressure against the paper can be low. It is also possible to increase the radius of curvature of the roller section 351 to make a surface that is flat in places. This area alone may be constructed of synthetic resin.

Next, the mechanism of the present invention by which the feeding of more than one paper at one time is prevented using this paper supply roller 350 will be explained.

The mechanism of the present invention for preventing the feeding of more than one paper at one time is the same as that shown in FIGS. 3 and 4, except that the paper-supply roller 350 of the present invention is used instead of the conventional paper-supply roller 303. The working of the roller 350 is exactly the same as described before with reference to FIGS. 5(*a*) to 5(*c*).

The paper-supply roller 350 is constructed so as to have the roller section 351 with small friction, so that in the situation shown in FIG. 5(*d*), unlike the situation when the conventional paper-supply roller 303 is used, there is a load at the time of paper supply. This load is adjustable by the establishment of an appropriate width of the roller section 351.

Figure 6:
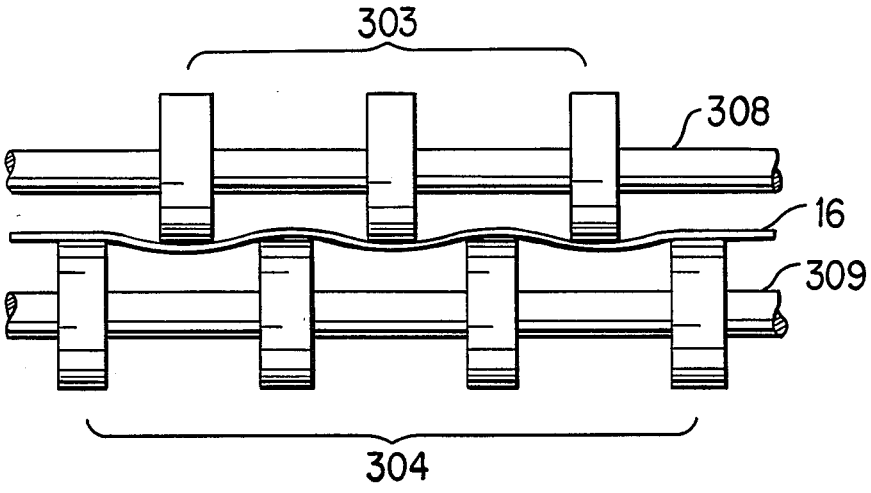
FIG. 6 PRIOR ART
FIG. 6 is a diagram showing the positional relationship between the paper-supply rollers, the paper, and the separation rollers when seen from the end of the paper shown in FIG. 5(*c*).
Figure 7:
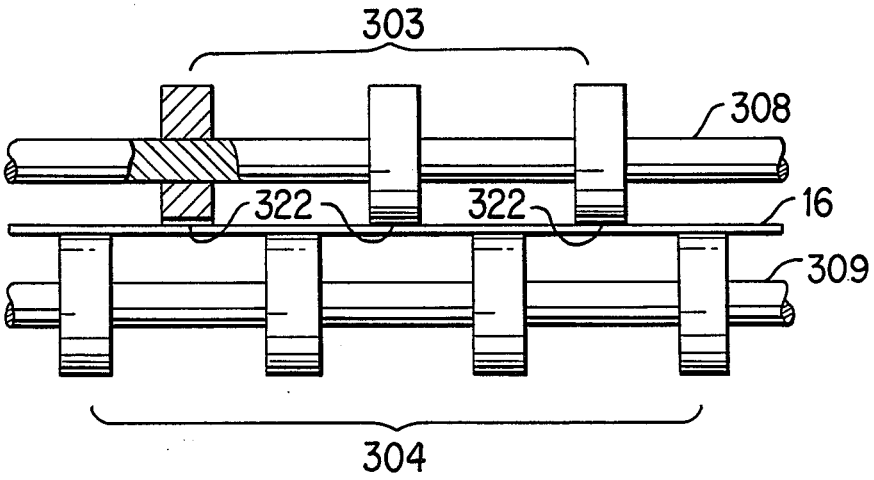
FIG. 7 PRIOR ART
FIG. 7 is a diagram showing the positional relationship between the paper-supply rollers, the paper, and the separation rollers when seen from the end of the paper shown in FIG. 5(*d*).

In addition, with the present invention, the situation shown in FIG. 5(*d*) when seen from the end of the paper is not that of FIG. 7 but instead like that in FIG. 6; the paper 16 is pressed against the separation roller 304. Therefore, the friction of the paper 16 against the paper-supply roller 303 is small, but the friction of the paper against the separation roller 304 is not decreased much.

Thus, when paper is moved downstream in the direction of paper conveyance to the resist roller 305, the separation roller 304 operates adequately, and the prevention of the feeding of more than one paper at one time can be achieved.

Example 2

Figure 2:
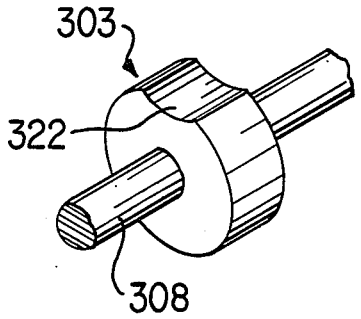
FIG. 2 PRIOR ART
FIG. 2 is a perspective view showing a conventional paper-supply roller.
Figure 9:
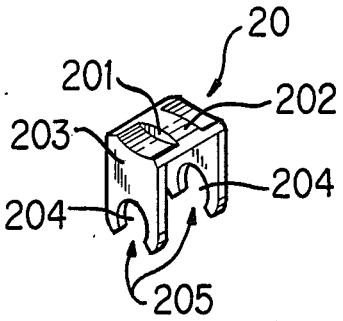
FIG. 9 is a perspective view showing an adapter used in the paper-supply roller shown in FIG. 8.
Figure 8:
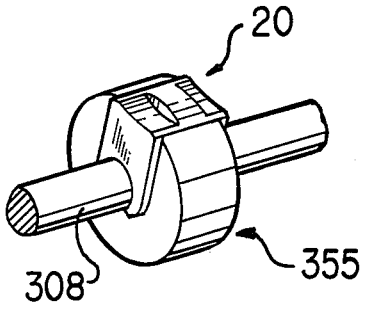
FIG. 8 is a perspective view showing another paper-supply roller of this invention.

FIG. 8 shows another paper-supply roller 355 of the present invention for preventing the feeding of more than one paper at one time. In this example, by installation of an adaptor 20 into the indented portion 322 of the conventional paper-supply roller 303, a roller with the same functions as the paper-supply roller shown in FIG. 1 is produced. This adaptor 20 is composed of a roller-compensating part 201 on the upper portion thereof and a supporting section 203 for supporting the roller-compensating part 201, as shown in FIG. 9. The roller-compensating part 201 has a shape corresponding to that of the indentation 322 of the conventional paper-supply roller 303 (FIG. 2). In its center, there is a roller-compensating section 202 that functions as one part of the outside of the roller. The supporting section 203 has two shaft holes 204 that incorporate openings 205 for insertion of the roller shaft. These hold in place the shaft, which is straddled by the paper-supply roller in the direction of the width of the paper-supply roller. This supporting section 203 is preferably made in one piece with the compensating part 201, of some such substance as synthetic resin, and the opening 205 is made so as to be slightly smaller than the diameter of the shaft hole 204. When the adaptor 20 of the above-mentioned structure is placed over the top of the indentation 322 in the conventional paper-supply roller 303, as shown in FIG. 8, the openings 205 of the supporting section 203 can be pressed open because of their elasticity, so that the roller shaft 308 can be inserted therethrough. Again, because of the elasticity that comes of being made of synthetic resin, the adaptor 20 holds the shaft 308 firmly in place.

When this paper-supply roller 355 is used in place of the conventional roller 303, the operation of the mechanism for preventing the feeding of more than one piece of paper at one time is the same as that shown in FIG. 5(*a*) to 5(*c*) for the conventional roller 303. The situation shown in FIG. 5(d) for the conventional roller 303 is illustrated in FIG. 10 for the roller of the present invention.

Figure 10:
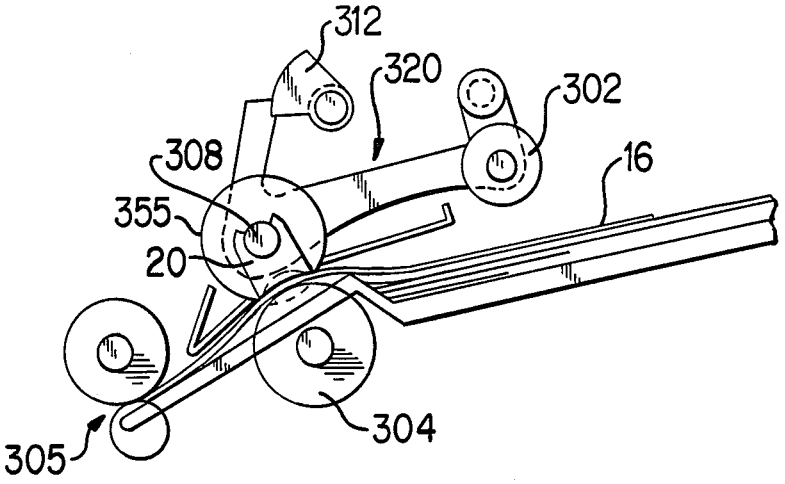
FIG. 10 is a schematic diagram showing operation of the paper-supply roller shown in FIG. 9.
Figure 11:
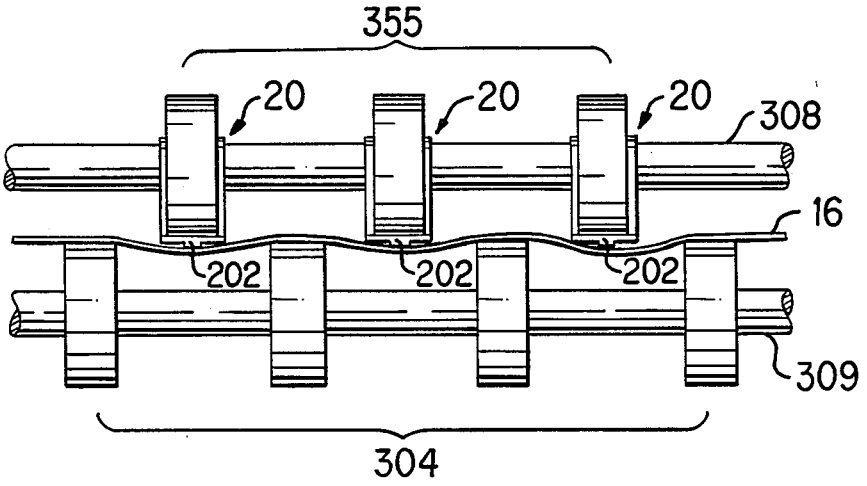
FIG. 11 is a diagram showing the positional relationship between the paper-supply rollers, the paper, and the separation rollers when seen from the end of the paper shown in FIG. 10.

When the paper-supply roller 355 rotates further, bringing about the situation shown in FIG. 10, then, as in FIG. 5(*d*), the paper arrives at the resist roller 305, and the pushing roller 302 is lifted upwards. To attain compensation of the slope of the paper, paper supply is temporarily stopped at the state where the paper is somewhat bent. After this, the resist roller 305 again sends the paper 16 in the downstream direction of paper conveyance. At that time, the adaptor 20 has its compensating part 201 facing the direction of the separation roller 304. This situation is shown looking from the end of the paper in FIG. 11, wherein roller-compensating section 202 is pressing against the surface of paper 16.

For that reason, the paper 16 is pressed by the separation roller 304, resulting in the friction therebetween so that the separation roller 304 functions properly as a separator, which prevents more than one paper from being fed at one time.

In addition, the surface area that touches paper 16 of the paper-supply roller 355 is only the width of the roller-compensating section 202 of the roller-compensating part 201, and accordingly the load required for the sending of paper in the downstream direction of paper conveyance by the resist roller 305 can be adjusted by the width of the roller-compensating section 202.

Therefore, compared to the conventional paper-supply rollers 303 in which there is an indentation in the outer surface, the separation effects achieved when the adaptor 20 of the present invention is used are much more reliable.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A mechanism for preventing the feeding of more than one sheet of paper at one time comprising a document feeder having a pair of parallel shafts, one of which is a paper-supply roller shaft supporting a plurality of paper-supply rollers, and the other of which is a separation roller shaft supporting a plurality of separation rollers, wherein the distance between the shafts is slightly less than the sum of the radii of said paper-supply rollers and said separation rollers, and said paper-supply rollers and said separation rollers are arranged in a zigzag manner, an outer peripheral surface of each of said paper-supply rollers serially having a large frictional section producing much friction between the paper-supply roller and the paper and a small frictional section producing little friction between the paper-supply roller and the paper, said small frictional section of said paper-supply roller is made of an adapter, which has a roller-compensating part including a roller-compensating section functioning as one part of the outside of the paper-supply roller and a supporting section for supporting said roller-compensating part that is to be put on the roller shaft so as to be straddled by the paper-supply roller in the direction of the width of the paper-supply roller.

2. A mechanism according to claim 1, wherein said supporting section is made of synthetic resin in one piece with said compensating part.

* * * * *